United States Patent [19]

McLaren et al.

[11] Patent Number: 4,594,817

[45] Date of Patent: Jun. 17, 1986

[54] MODULAR SLEEPING UNITS

[76] Inventors: Charles L. McLaren, 1911 Pear Creek Cir., Houston, Tex. 77084; Franklin D. Hirsekorn, 105 Rosamond, Houston, Tex. 77076

[21] Appl. No.: 413,563

[22] Filed: Aug. 31, 1982

[51] Int. Cl.[4] ..... A47B 83/00

[52] U.S. Cl. ..... 52/34; 52/36; 52/79.12; 52/143; 52/204; 5/2 R; 5/432

[58] Field of Search ..... 52/79.2, 79.12, 79.1, 52/36, 34, 79.3, 79.13, 143, 204; 5/1, 2 R, 2 B, 9 R, 9 B, 432; 114/188, 189; 105/315, 322, 314, 316, 317, 318, 319; 312/237

[56] References Cited

U.S. PATENT DOCUMENTS

| | | | |
|---|---|---|---|
| 1,242,545 | 10/1917 | Hanger | 5/1 |
| 1,857,189 | 5/1932 | Gillespie | 52/36 |
| 2,092,655 | 9/1937 | Page | 5/9 R |
| 2,607,047 | 8/1952 | Posey | 5/1 |
| 2,816,330 | 12/1957 | Sherron | 52/36 |
| 2,884,873 | 5/1959 | Candlin | 105/315 |
| 2,900,956 | 8/1959 | Hoffman | 5/9 R |
| 2,914,001 | 11/1959 | Murphy | 105/315 |
| 3,118,187 | 1/1964 | Alimanestiano | 105/315 |
| 3,507,080 | 4/1970 | Van Hezik | 52/79.2 |
| 3,553,911 | 1/1971 | Morrow | 52/36 |
| 3,574,390 | 4/1971 | Metsker | 52/79.1 |
| 3,623,285 | 11/1971 | Kelly | 52/36 |
| 3,638,380 | 2/1972 | Perri | 52/79.12 |
| 3,778,528 | 12/1973 | Heifetz | 52/79.1 |
| 3,823,520 | 7/1974 | Ohta | 52/79.12 |
| 3,905,167 | 9/1975 | Watkins | 52/292 |
| 3,913,286 | 10/1975 | Boutacoff | 52/79.1 |
| 3,923,134 | 12/1975 | Rezazadeh | 52/79.1 |
| 4,071,210 | 1/1978 | Mutke | 5/9 R |
| 4,238,858 | 12/1980 | Maihart | 52/79.1 |
| 4,272,930 | 6/1981 | Foster | 52/79.1 |
| 4,395,785 | 8/1983 | Phil-Yool-Huh | 5/432 |

FOREIGN PATENT DOCUMENTS

| | | | |
|---|---|---|---|
| 670541 | 1/1939 | Fed. Rep. of Germany | 5/1 |
| 1408922 | 7/1965 | France | 52/36 |
| 11551 | of 1892 | United Kingdom | 5/9 R |

OTHER PUBLICATIONS

Engineering-News-Record, Jun. 2, 1949, pp. 16-18.

*Primary Examiner*—John E. Murtagh
*Attorney, Agent, or Firm*—Neal J. Mosely

[57] ABSTRACT

Sleeping modules are disclosed which are of elongated box shape construction with open ends for access. The are about length and width of a single bed and of sufficient height for an occupant to sit upright. The modules assembled in stacks or columns of two or more modules supported one above the other in parallel relation in a supporting framework and arranged in rows together with bathrooms and other accommodations. The sleeping modules are assembled into portable building units which may be used for portable sleeping accommodations at parks, sporting events, and other locations where temporary or permanent inexpensive sleeping accommodations are desired. Additionally, the sleeping modules may be assembled into larger building units or other suitable accommodations to provide facilities for dormitories, barracks, or places of confinement such as correctional institutions. Portable buildings containing sleeping modules are especially useful to provide sleeping accommodations in places where access is limited and conventional sleeping accommodations are difficult to construct. Buildings containing the sleeping modules are especially useful for sleeping accommodations on off shore oil rigs and for sleeping accommodations along highways, e.g. truck stops and the like.

22 Claims, 8 Drawing Figures

MODULAR SLEEPING UNITS

BACKGROUND OF THE INVENTION

1. Field of the Invention

This invention relates to individual sleeping modules or capsules and assemblies of sleeping modules in inexpensive building arrangements, both fixed and portable types.

2. Brief Description of the Prior Art

The prior art discloses a number of arrangements for compact sleeping accomodations, particularly as used in sleeping cars on railway trains, sleeping accomodations on buses, sleeping accomodations on airplanes, and the like.

Willson U.S. Pat. No. 2,577,836 discloses a self powered mobile vehicle, of the recreational vehicle type, having small compact sleeping accomodations in a second story.

Hoffman U.S. Pat. No. 2,900,956 discloses an arrangement of cages or kennels having individual beds extending from front to back with front openings.

Pitta U.S. Pat. No. 2,960,292 discloses individual capsules to accomodate the body of a airplane passenger. The capsules are described as providing protection for passengers in an accident or crash.

Shea U.S. Pat. No. 3,484,131 discloses an elongated trailer arranged to be pulled by a truck-tractor. The trailer has a number of doors along one side opening into individual sleeping compartments.

Burgess U.S. Pat. No. 3,694,023 discloses a motorhome or recreational vehicle having a plurality of cribs or small beds installed along opposite walls of the vehicle.

LeGrand U.S. Pat. No. 3,784,989 discloses an arrangement of multiple sleepig berths for use in vehicle. The multiple levels are contoured for economy of space and relaxation.

Harder U.S. Pat. No. 3,808,607 discloses a multiple purpose apparatus for sleeping, cooking, bathing, toilet, etc.

Hollingsworth U.S. Pat. No. 3,950,796 discloses an article of children's furniture, including two seats or beds with an enclosure therebetween.

Mutke U.S. Pat. No. 4,071,210 discloses an arrangement of multiple berths for sleeping in an aircraft. The berths provide separate cells for sleeping and are mounted on tracks for movement therein.

In addition to these patents, there is type of individual sleeping module which has been in use in Japan, but not in the United States, which is not believed to be patented or otherwise known in the prior art. The present invention consists of a series of modular units which are improvements on the modular unit presently known in Japan, both with regard to the structure of the individual units and the manner in which the individual sleeping modules are assembled for use.

SUMMARY OF THE INVENTION

One of the objects of this invention is to provide a new and improved sleeping module.

Another object of the invention is to provide a new and improved sleeping module of molded plastic construction which is inexpensive to construct and easy to use.

Another object of the invention is to provide a new and improved sleeping module of molded and formed plastic construction having a mattress for comfort and provided with a variety of amenities for the individual occupant.

Still another object of this invention is to provide a new and improved sleeping module of molded or formed plastic having a comfortable mattress, which is individually heated or air conditioned, and provided with radio or television, intercom, and privacy enclosure.

Still another object of the invention is to provide a new and improved sleeping module having a box type shape with an end opening and having a mattress about the size for comfort and provided with a variety of amenities for the individual occupant.

Still another object of this invention is to provide a new and improved sleeping module of molded or formed plastic having a comfortable mattress, individually heated or air conditioned, and provided with radio or television, intercom, and privacy enclosure.

Still another object of the invention is to provide a new and improved sleeping module having a box type shape with an end opening and having a mattress about the size of a single bed, the module being of sufficient height for an occupant to sit upright and being provided with a bulge or recess at the closed end thereof with a back cushion for sitting up in the module.

Another object of the invention of the invention is to provide an assembly of individual sleeping modules in a portable building.

Still another object of the invention is to provide an assembly of sleeping modules together with bath room facilities and storage locker facilities in a portable building unit.

Still another object of the invention is to provide an assembly of sleeping modules, bathroom facilities, storage lockers, and the like in a fixed building unit of the dormitory or barracks or correctional institution type.

Other objects of this invention will become apparent from time to time throughout the specification and claims as hereinafter related.

The foregoing objects and the other objects of this invention are accomplished by sleeping modules which are of elongated box shape construction with open ends for access. The are about length and width of a single bed and of sufficient height for an occupant to sit upright.

The modules assembled in stacks or columns of two or more modules supported one above the other in parallel relation in a supporting framework and arranged in rows together with bathrooms and other accomodations. The sleeping modules are assembled into portable building units which may be used for portable sleeping accomodations at parks, sporting events, and other locations where temporary or permanent inexpensive sleeping accomodations are desired.

Additionally, the sleeping modules may be assembled into larger building units or other suitable accomodations to provide facilities for dormitories, barracks, or places of confinement such as correctional institutions. Portable buildings containing sleeping modules are especially useful to provide sleeping accomodations in places where access is limited and conventional sleeping accomodations are difficult to construct. Buildings containing the sleeping modules are especially useful for sleeping accomodations on off shore oil rigs and for sleeping accomodations in bus or train stations or airports or along highways, e.g. truck stops and the like.

DESCRIPTION OF THE PREFERRED EMBODIMENT

The sleeping modules of this invention are designed for use in various types of sleeping compartments. The sleeping modules are preferably supported in columns of two or more modules supported one over the other in parallel relation in a suitable supporting framework and arranged in rows together with bathrooms and other accomodations. The sleeping modules are easily assembled into portable building units which may be used for portable sleeping accomodations at parks, sporting events, and other locations where temporary or permanent, inexpensive sleeping accomodations are desired.

In addition, the sleeping modules may be assembled into larger building units with other suitable accomodations to provide facilities for dormitories, barracks, or places of confinement such as correctional institutions. Portable buildings containing the sleeping modules are especially useful to provide sleeping accomodations in places where access is limited and conventional sleeping accomodations are difficult to construct. Portable buildings containing the sleeping modules are especially useful for sleeping accomodations on off-shore oil rigs and for sleeping accomodations along highways, e.g. truck stops and the like.

Figure 1:
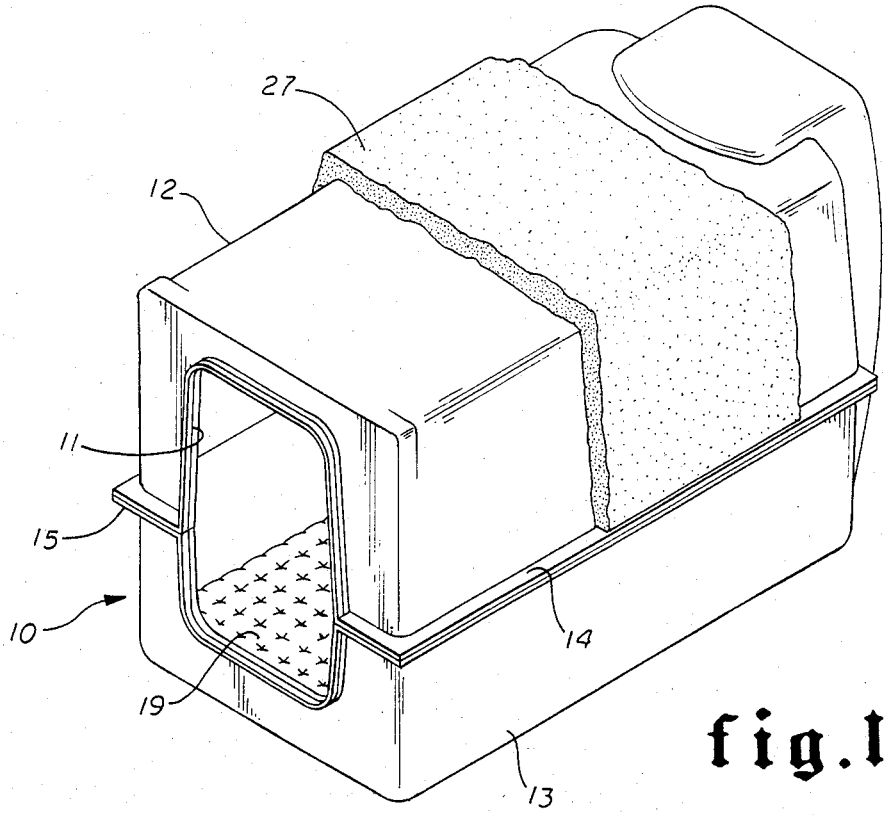
FIG. 1 is an isometric view from the front and top of a sleeping module representing one preferred embodiment of the invention.
Figure 2:
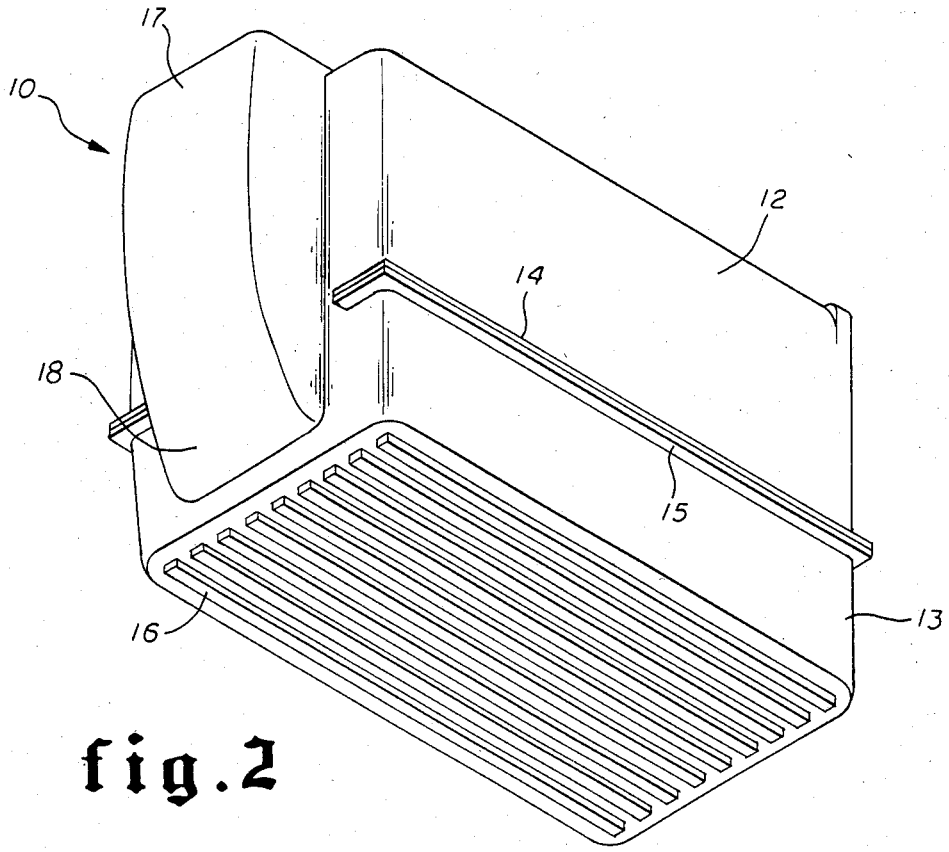
FIG. 2 is an isometric view from the rear and the bottom of the sleeping module shown in FIG. 1.

Referring to the drawings by numerals of reference, an more particularly to FIGS. 1 and 2, there is shown a sleeping module 10 comprising a hollow elongated box or capsule having a front opening 11 and formed of an upper section 12 and a lower section 13. Upper section 12 and lower section 13 are of molded or formed plastic construction and are preferably formed by a vacuum forming process into the shape shown.

A peripheral flange 14 surrounds the base portion of upper capsule section 12 and surrounds the upper part of the opening 11. A peripheral flange 15 surrounds the upper portion of the lower capsule section 13 and the lower portion of the front opening 11. Flanges 14 and 15 are secured together by adhesive or by clamps or screws or other suitable securing means. The bottom section 13 of sleeping module 10 has a plurality of reinforcing ribs 16 formed therein.

At the lower end of sleeping module 10, upper section 12 has a rearwardly extending bulge 17 which is aligned with a similar rearwardly extending bulge 18 on lower module section 13. The rearwardly extending bulges 17 and 18 form a recess or cavity at the rear end of the sleeping module to provide a back support for an individual sitting up inside the module. Sleeping module 10 is provided with a mattress 19 which is supported on the ribbed bottom 16. Further details of the sleeping module 10 will be described in connection with the installation of the modules in various types of sleeping compartments.

As will be seen from the description of the various applications of the sleeping modules, it will be seen that the sleeping modules 10 are designed for use in various types of sleeping compartments. The sleeping modules are preferably supported in banks or columns of two or more modules supported one over the other in parallel relation in a suitable supporting framework (see FIG. 3) and arranged in rows together with bathroom and other facilities.

Figure 3:
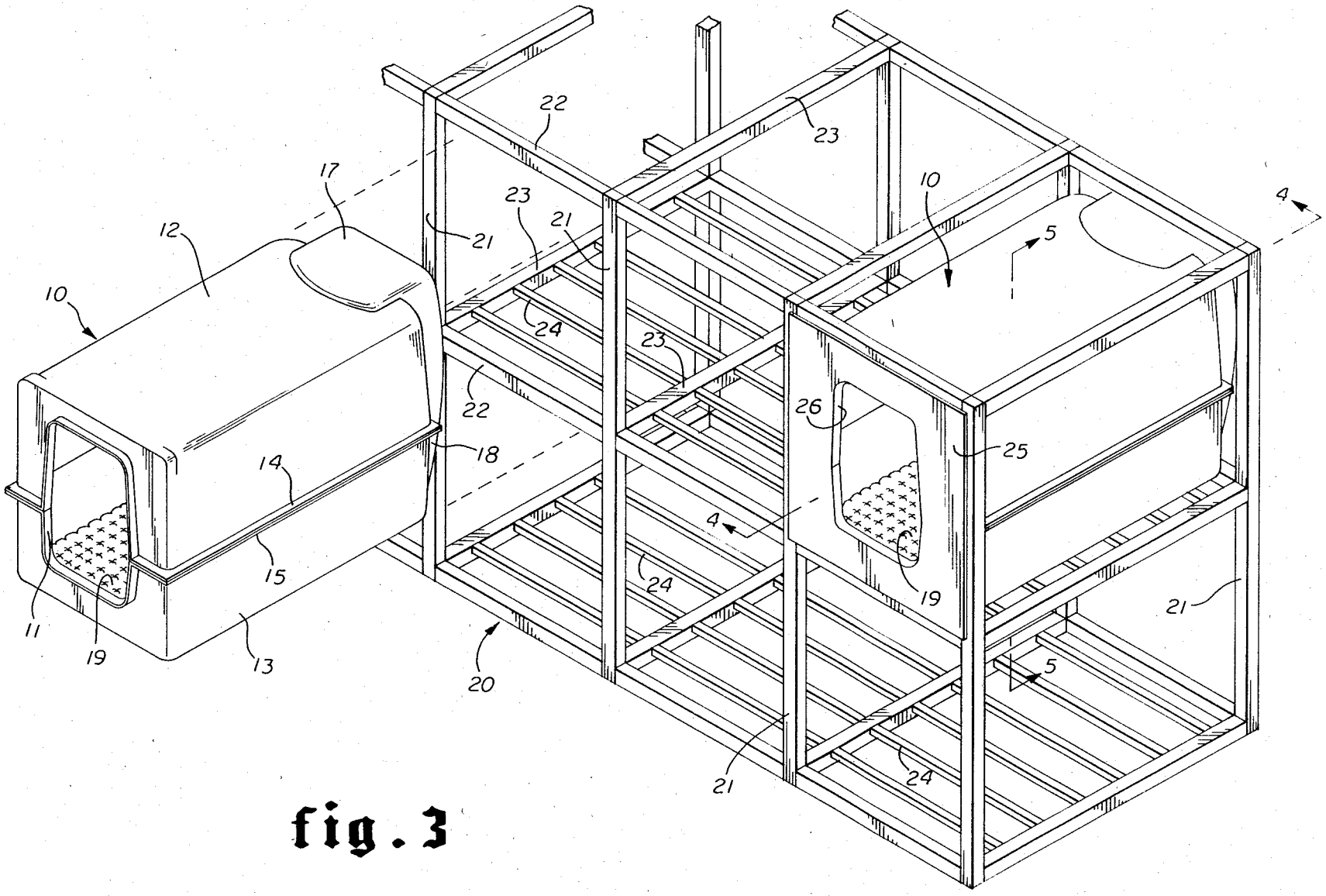
FIG. 3 is an isometric view, partially exploded, showing the installation of the sleeping modules in a supporting rack or framework.

In FIG. 3, there is shown a supporting framework 20 having vertically extending supports 21 and horizontally extending supports 22 and 23. Horizontal supports 22 extend laterally of framework 20 as viewed from the front of the framework. Horizontal supports 23 extend from front to back of the framework. The horizontal supports 23 which extend from front to back have a plurality of supporting rods or braces 24 which extend in parallel relation to the laterally extending supports 22. Supports 22, 23 and 24 therefore provide a supporting bed on which each of the sleeping modules 10 is supported At the upper right end of the supporting rack or framework 20 shown in FIG. 3, one of the sleeping modules 10 is shown installed in the rack with a face plate 25 closing the end of the sleeping module and the front opening of the supporting framework in which it is supported. Face plate 25 has an opening 26 which registers with opening 11 in sleeping module 10. Sleeping module 10 is also provided with a covering 27 of insulation which is about one-half inch thick. Insulation 27 provides sound deadening and is also a heat insulation material.

Figure 4:
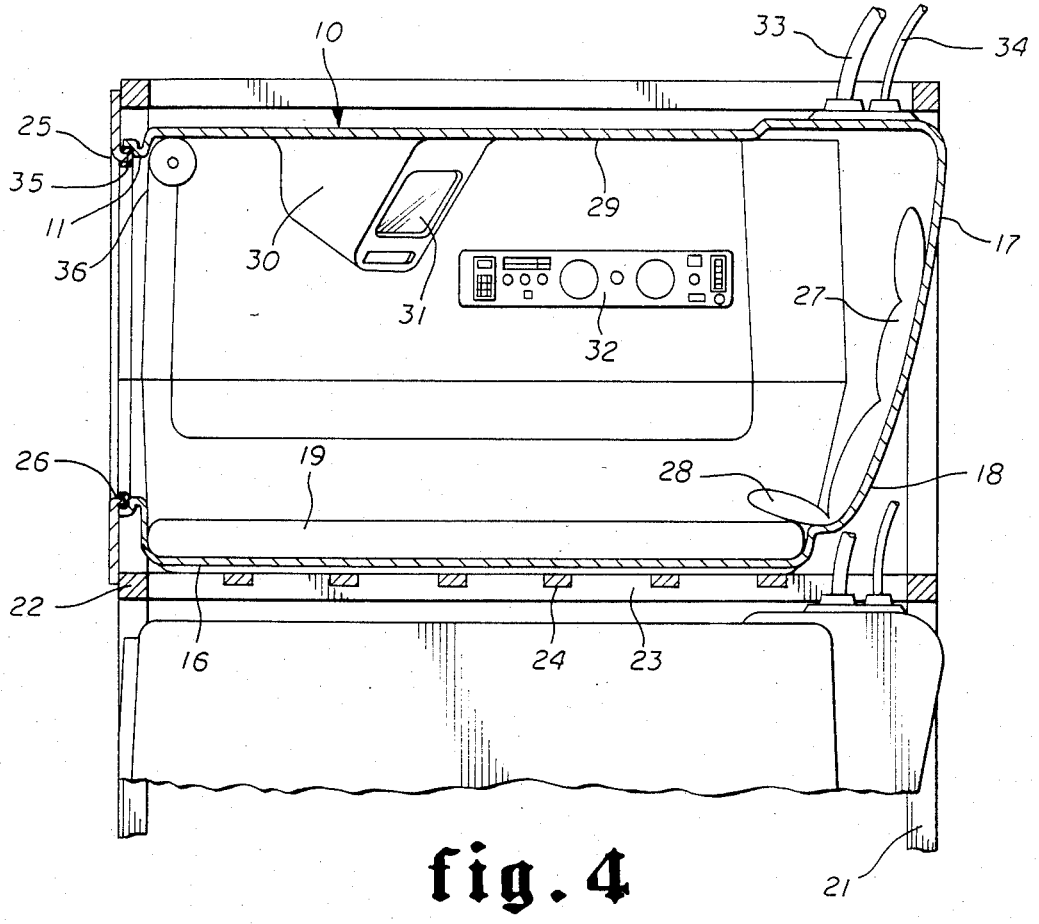
FIG. 4 is a sectional view taken on the line 4—4 for FIG. 3.
Figure 5:
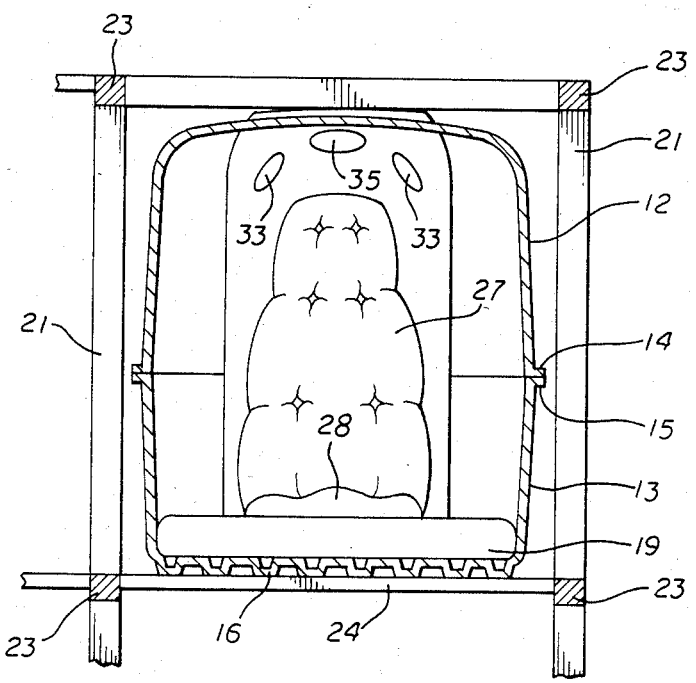
FIG. 5 is a sectional view taken on the line 5—5 of FIG. 3.

In FIGS. 4 and 5 of the drawings, there are shown sectional views through the sleeping module 10 and the supporting framework which provide a fuller understanding of the structure. In FIG. 4, the entire length of sleeping module 10 is seen. Mattress 19 is shown extending from end to end of the module and is supported on the ribbed bottom 16. The length of the mattress 19 is sufficient for a relatively tall man, i.e. six foot three inches.

At the rear end of the sleeping module, there is shown a pillow having a vertically extending portion 27 and a horizontally extending portion 28. Horizontally extending pillow portion 28 provides a headrest during sleeping. The vertically extending pillow portion 27 extends along the grooved bulge formed by the bulge portions 17 and 18 of the upper section 12 and lower section 13 of the sleeping module. The curvature of the bulge supports vertically extending pillow portion 27 along a curvature designed for maximum comfort for person sitting up in the sleeping module.

The height of each of the modules 10 from the mattress 19 to the top wall 29 is just sufficient for a relatively tall man, e.g., up to about six foot three inches in height, to sit upright against the vertically extending pillow 27 but insufficient for a normal adult to stand therein. This height relationship is apparent from the length of the mattress set forth above and height of the stacked modules shown in FIG. 6 and described below. The upper wall 29 has a molded casing 30 formed to receive a television set 31 which has the picture tube arranged for viewing by the occupant of the sleeping module. A control panel 32 is provided to the side of the sleeping module with controls for lights, ventilation, air conditioning, heat, intercom, etc.

The sleepig modules 10 are provided with conduits 33 and 34 which are connected to the upper wall 29 adjacent to the rear bulge 17. Conduit 33 conducts air for ventilation and provides for heating and air conditioning by heating or cooling of the air in response to the controls on panel 32. Conduit 34 is a wiring conduit which connected to lights 35 which illuminate the interior of the capsule.

At the front end of each of the capsules 10, the face plate 25 is sealed as indicated at 135 where openings 26 and 11 come together. At the entrance or opening to the capsule there is provided a screen 36 which can close the opening for privacy of the individual occupant of the capsule. The individual modules provide complete comfort for a single occupant. Obviously, it would be possible to build modules wider to provide for multiple occupancy if desired. The individual sleeping modules allow an individual occupant to have privacy by closing the curtain or screen 36.

The modules are individually heated or air conditioned according to the demands of the occupant who may operate control panel 32 to obtain the desired comfort level. The arrangement of cushions 27 and 28 allows the individual occupant to sit fully upright in the rear portion of the module in a position having a maximum comfort level. In fact, the curvature of the bulge formed by bulge portion 17 and 18 supporting vertically extending cushion portion 27 is a design which has been worked out for maximum comfort in the seating arrangements for buses, trains and airplanes.

The television set 31 is optional feature in the sleeping modules and provides for individual entertainment. Control panel 32 includes an intercom for communication between the occupant and the management of the building unit containing the capsules. Control panel 32 also includes air conditioning, heating and ventilating controls, an individual radio or stereo, and additional lighting as needed. The complete sleeping modules, including accessories, provide a high level of comfort in a very small compact space. The modules can be arranged in a variety of patterns to provide compact sleeping accomodations for a variety of implications.

The sleeping modules are easily assembled into portable building units (FIGS. 6 and 8) which may be used for portable sleeping accomodations at parks, sporting events, and other locations where temporary or permanent inexpensive sleeping accomodations are desired.

Portable buildings containing the sleeping modules are especially useful to provide sleeping accomodations in places where access is limited and conventional sleeping accomodations are difficult to construct. Portable buildings containing the sleeping modules are especially useful for sleeping accomodations on off-shore oil rigs and for sleeping accomodations along highways, e.g. truck stops and the like.

Figure 6:
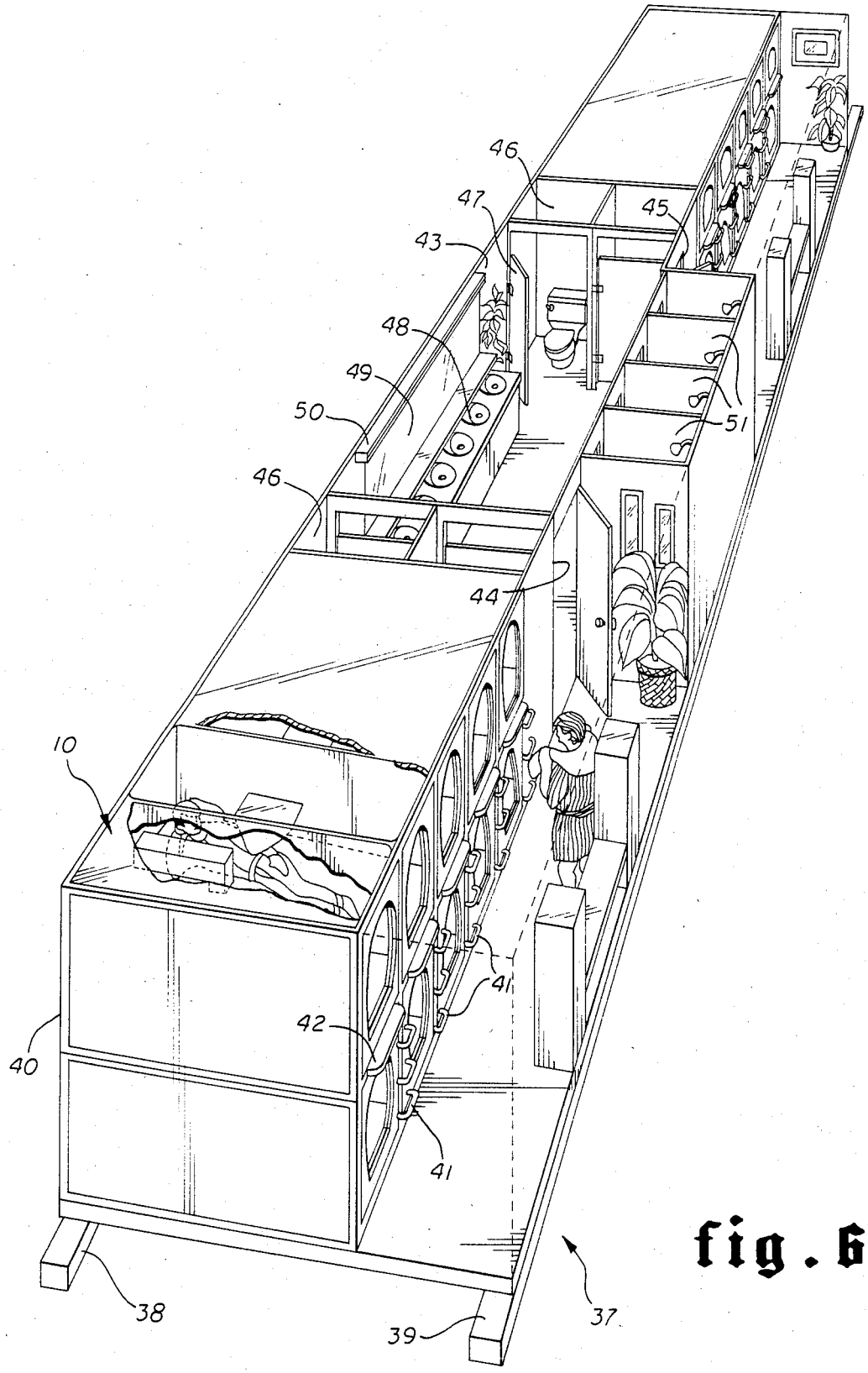
FIG. 6 is an isometric view, with part of the walls removed, of a portable building containing a plurality of the sleeping modules and other accomodations.

In FIG. 6, a plurality of sleeping modules 10 are assembled in a portable building 37. The building 37 could be mounted on wheels and moved to any suitable site by a tractor-trailer arrangement. In FIG. 6, portable building 37 is shown supported on skids 38 and 39. Portable building 37 can be provided at remote sites such as parks and wilderness areas. It can also be provided for sporting events or the like where temporary sleeping accomodations are required. This type of portable unit is also readily adaptable for use on and off-shore drilling rig.

Portable sleeping building 37, as shown in FIG. 6, provides accomodations for twenty occupants. In this portable building, the sleeping modules 10 are supported in columns of two, with one module supported above the other. There are five rows of the sleeping modules 10 at opposite ends of the portable building. Sleeping modules 10 are supported along the rear wall 40 of the portable building 37 and extend laterally outward. Stepping rungs 41 are provided between the respective columns of the sleeping modules to assist the occupant in climbing into the upper module.

A ledge or step 42 is provided at the opening of each of the upper modules. The central portion of portable building 37 comprises a bathroom area 43. This area is accessed by doors 44 and 45 from opposite ends. A plurality of toilet rooms 46 are provided, each having a privacy door 47. A plurality of sinks 48 extend along the back wall 40 of the building and face a mirror 49 which is provided with suitable lighting 50. A plurality of shower stalls 51 are provided to handle bathing.

The sleeping modules may also be assembled into larger building units (FIG. 7) with other suitable accomodations to provide facilities for dormitories, barracks, or places of confinement such as correctional institutions.

Figure 7:
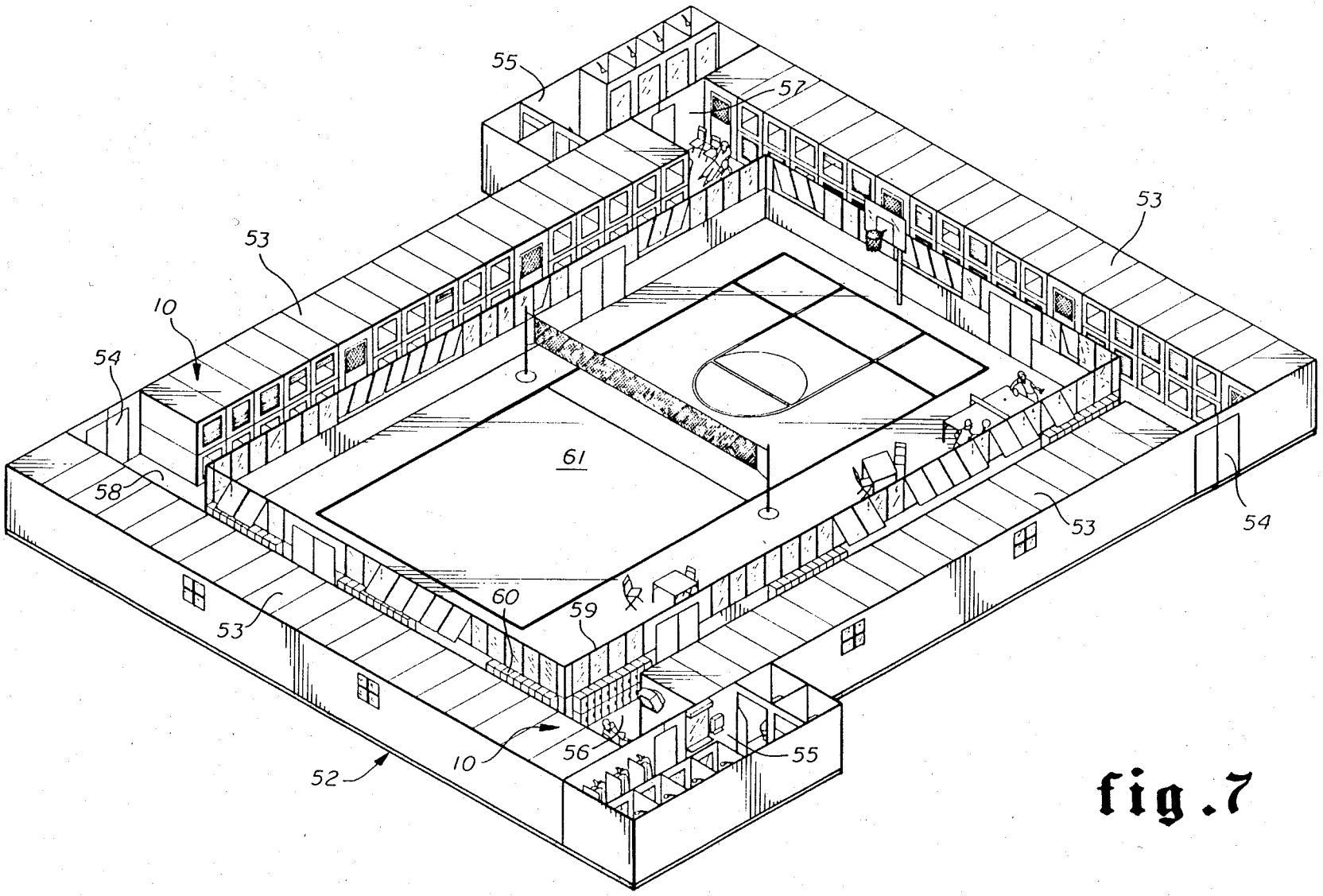
FIG. 7 is an isometric view, with the roof removed, of a plurality of sleeping modules arranged as a dormitory or other place of confinement.

In FIG. 7, the sleeping modules 10 are shown assembled in a fixed building installation. Of course, individual section of the building could be portable. The building installation 52, shown in FIG. 7, is a dormitory or barracks type structure which could also be used for the inmates of a correctional institution. Building 52 is rectangular in shape and has banks or rows 53 of sleeping modules 10 around the exterior walls. The building is provided with a plurality of exits 54 which, in the case of a correctional institution may be under suitable security.

Building 52 is provided with bathroom 55 and alcoves 56 and 57 for attendants or guards. Hallways or aisles 58 extend around the periphery of inner wall 59. A plurality of storage lockers 60 are provided for storage of clothing and personal effects. Inner wall 59 surrounds a recreational area 61 which includes tennis, basketball, and other recreational facilities. The structure shown in FIG. 7 is enclosed by a suitable roof structure, which is not shown.

Figure 8:
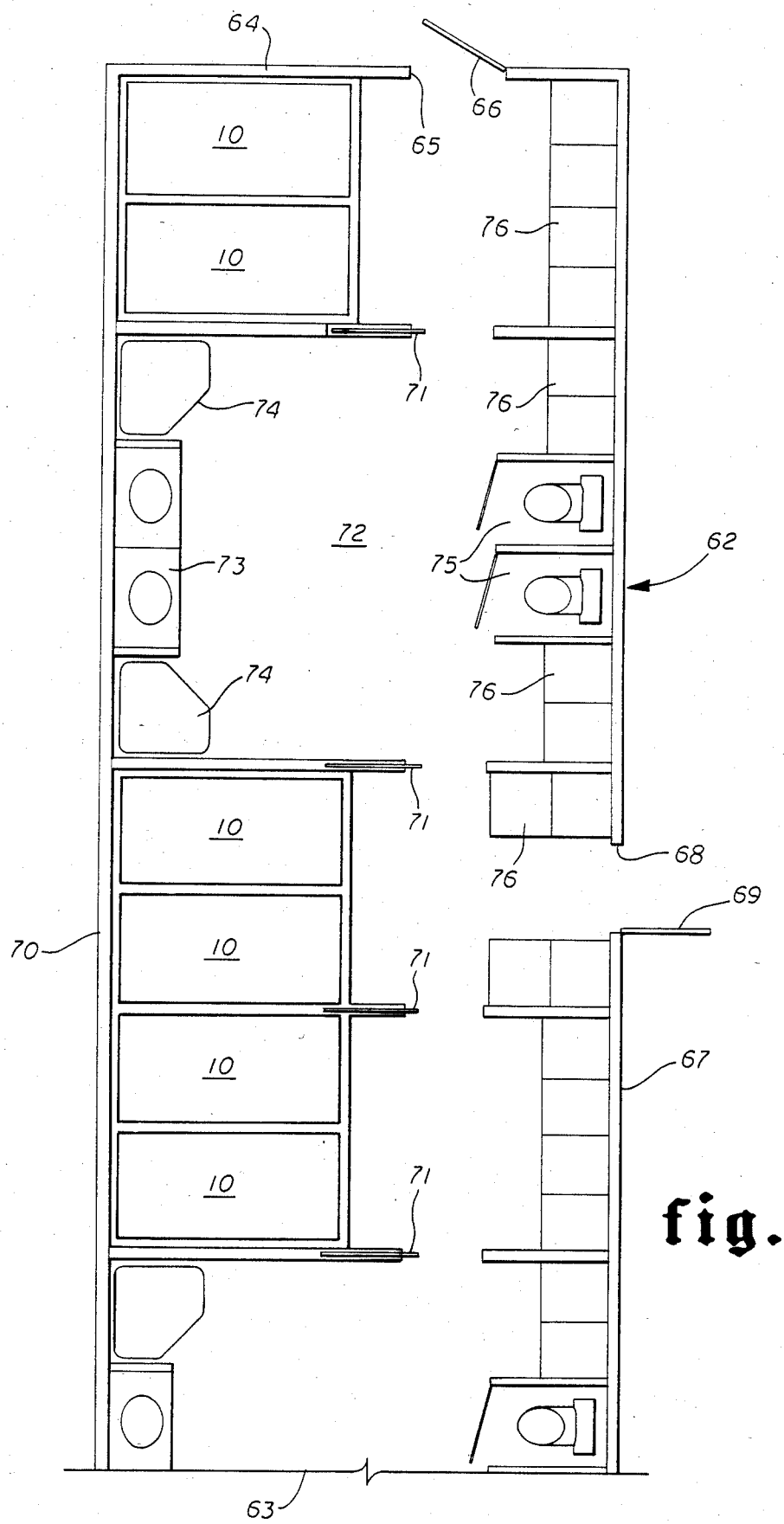
FIG. 8 is a schematic plan view showing a portable building containing a plurality of sleeping modules with privacy doors and bathroom accomodations.

In FIG. 8, there is shown another embodiment of a portable housing unit or building 62 which is quite similar to the portable building 37 shown in FIG. 6. FIG. 8 shows only the right end portion of the portable building. A similar portion could extend to the left of center line 63 or the building could be made even longer. Building 62, in FIG. 8, is shown in the form of a schematic plan view. One end 64 of building 62 is provided with a doorway 65 and door 66. One side wall 67 is provided with a door 68 and door 69. The other side wall 70 has the modules 10 positioned with their rear ends thereagainst. Modules 10 extend laterally outward toward the wall 62.

In building 62 sleeping modules 10 are arranged in groups of four modules, two up and two down. The modules are supported in supporting framework as in the other embodiments, but sliding doors 71 are provided between adjacent groupings of the sleeping modules. Bathroom area 72 is provided in a location between to sets of modules. The bathroom area 72 includes sinks 73 and showers 74 along wall 70. toilet facilities 75 are provided along wall 67. Storage lockers 76 are also provided along wall 67. The arrangement of sleeping modules and bathroom areas is repeated along the length of the building 62. Sliding doors 71 provide for privacy for dressing and also privacy for the bathroom areas.

The sleeping modules 10 may be arranged in a variety of combinations as has been illustrated in the several embodiments shown. Sleeping modules 10 are preferably used in portable structures which may be skid-mounted on truck-trailers, wheeled trailers, for hauling to and from remote areas where the sleeping accomodations are needed. As noted in FIG. 7, the sleeping modules may also be used to provide a very comfortable and compact dormitory or barracks structure which may also be used as a low security correctional institution. The sleeping modules 10, together with bathroom and storage facilities, as well as optional recreational facilities provide for very compact and comfortable sleeping accomodations. Sleeping modules 10 arranged either in portable or fixed or permanent mounting installations provide sleeping accomodations at a fraction of the cost of conventional construction.

While this invention has been described fully and completely with special emphasis on several preferred embodiments, it should be understood that within a scope of the appended claims the invention may be practiced otherwise than as specifically described and shown herein.

We claim:

1. A modular sleeping structure comprising a building enclosure having at least one doorway and door for entrance and exit, a plurality of sleeping modules in said building enclosure, some of said modules being supported in vertical columns of at least two modules, each of said modules being of elongated box shaped construction with an open entrance end, a closed end, and closed top, bottom and side walls, said modules each comprising an upper and a bottom part of a formed sheet plastic material and fitting together to form said open ended box shaped structure, said modules each being the size of a standard single bed and a height just sufficient for an occupant, of normal size, up to about six feet three inches in height, to sit upright but less than standing height, said closed end of each module being flat along opposite sides thereof with a central portion extending outward between said flat sides to form a bulge of recess with side walls between which a person may sit upright, each said bulge or recess at said closed end being of a shape defining a comfortable back rest extending from side to side partially around the person sitting therein, a mattress covering the floor, a vertically-extending back cushion fitting the back wall of said closed end bulge, and openings in said closed walls provided with connections for air conditioning, ventilation and lighting.

2. A sleeping structure according to claim 1 including a horizontally-extending seat cushion in each module secured to said back cushion of a size and at a location for use as a sleeping pillow.

3. A modular sleeping structure according to claim 1 in which each of said modules is surrounded by a layer of heat- and sound-deadening insulation.

4. A modular sleeping structure according to claim 1 in which at least one wall of each of said modules includes controls for lighting, air conditioning, and radio, television or an intercom.

5. A modular sleeping structure according to claim 4 including lighting, intercom and radio or television equipment supported on at least one wall of each of said modules.

6. A modular sleeping structure according to claim 1 in which said building includes a plurality of supporting racks for said sleeping modules supporting the same in parallel relation in banks or columns of at least two modules and a plurality of modules in side by side relation.

7. A modular sleeping structure according to claim 6 in which said building include at least one wall defining a bathroom area separated from an area containing said sleeping modules and bathing and toilet fixtures therein.

8. A modular sleeping structure according to claim 7 in which there are a plurality of bathroom areas spaced along the length of said building, with groups of said sleeping modules in separate and distinct areas separating said bathroom areas, and including privacy doors separating said bathroom areas from said modules and separating selected modules from other selected modules.

9. A modular sleeping structure according to claim 1 including a wall at the closed end of each of said modules with an end opening therein, and means for closing said end opening from the inside of said module to provide privacy for the occupant.

10. A modular sleeping structure according to claim 1 in which each module is surrounded by a layer of heat- and sound-deadening insulation, at least one wall of each said module includes controls for lighting, air conditioning, and radio, television or a intercom, and including lighting, intercom an radio or television equipment supported on at least one wall of each of said modules, said building includes a supporting rack for said sleeping modules supporting the same in parallel relation in banks or columns of at least two modules and a plurality of modules in side by side relation, said building includes a plurality of walls defining bathroom areas separated from said sleeping modules and bathing and toilet fixtures therein, there being a plurality of bathroom areas spaced along the length of said building with groups of said sleeping modules separating said areas, and including privacy doors separating said bathroom areas from said modules and separating selected modules from other selected modules, and means for closing said end opening from the inside of each said module to provide privacy for the occupant.

11. A modular sleeping structure according to claim 1 in which said building enclosure comprises a portable building mounted on skids for moving.

12. A modular sleeping structure according to claim 1 in which said building enclosure comprises a portable building mounted on wheels for moving.

13. A modular sleeping structure according to claim 1 in which said building enclosure comprises a fixed building.

14. A modular sleeping structure according to claim 13 in which said building includes storage and recreational areas.

15. A sleeping module of elongated box shaped construction with an open entrance end, a closed end, and closed top, bottom and side walls, said module comprising an upper and a bottom part of a formed sheet plastic material and fitting together to form said open ended box shaped structure, said module being the size of a standard single bed and a height just sufficient for an occupant, of normal size, up to about six feet three inches in height, to sit upright but less than standing height, said closed end of each module being flat along opposite sides thereof with a central portion extending outward between said flat sides to form a bulge of recess with side walls between which a person may sit upright, said bulge or recess at said closed end being of a shape defining a comfortable back rest extending from side to side partially around the person sitting therein, a mattress covering the floor, a vertically-extending back cushion fitting the back wall of said closed end bulge, and openings in said closed walls provided with connections for air conditioning, ventilation and lighting.

16. A sleeping module according to claim 15 including a seat cushion, associated with said back cushion, which is of a size and location for use as a sleeping pillow.

17. A sleeping module according to claim 15 in which said box shaped structure is surrounded by a layer of heat- and sound-deadening insulation.

18. A sleeping module according to claim 15 in which at least one wall of each said module includes controls for lighting, air conditioning, and radio, television or an intercom.

19. A sleeping module according to claim 18 including lighting, intercom and radio or television equipment supported on at least one closed wall of said module.

20. A sleeping module according to claim 15 including a wall at said open end with an end entrance opening therein, and means for closing said end entrance opening from the inside of said module to provide privacy for the occupant.

21. A building comprising a plurality of sleeping modules of the type defined in claim 15 in which said module is surrounded by a layer of heat- and sound-deadening insulation, at least one closed wall of each said module includes controls for lighting, air conditioning, and radio, television or an intercom, and including lighting, intercom and radio or television equipment supported on at least one wall said modules, said building includes a supporting rack for said sleeping modules supporting the same in parallel relation in banks or columns of at least two modules and a plurality of modules in side by side relation, said building includes a plurality of walls defining bathroom areas separated from said sleeping modules and bathing and toilet fixtures herein, there being a plurality of bathroom areas spaced along the length of said building, with groups of said sleeping modules separating said areas, and including privacy doors separating said bathroom areas from said modules and separating selected modules from other selected modules, a wall at said open end with an end opening therein, and means for closing said end opening from the inside of each said module to provide privacy for the occupant.

22. An assembly of sleeping modules as defined in claim 15 comprising a supporting rack for said sleeping modules supporting the same in parallel relation in banks or columns of at least two modules and a plurality of columns or banks of said modules in side by side relation.

* * * * *